US009359728B2

(12) United States Patent
Wachsmann

(10) Patent No.: US 9,359,728 B2
(45) Date of Patent: Jun. 7, 2016

(54) MILLING DRUM COMPRISING A, MORE PARTICULARLY REPLACEABLE, MATERIAL GUIDING DEVICE AND MATERIAL GUIDING DEVICE FOR A MILLING DRUM

(71) Applicant: BOMAG GmbH, Boppard (DE)

(72) Inventor: Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/185,285

(22) Filed: Feb. 20, 2014

(65) Prior Publication Data

US 2014/0239700 A1 Aug. 28, 2014

(30) Foreign Application Priority Data

Feb. 22, 2013 (DE) ..... 10 2013 003 088
Feb. 12, 2014 (DE) ..... 10 2014 001 921

(51) Int. Cl.

| | |
|---|---|
| ***E01C 23/088*** | (2006.01) |
| ***E01C 23/12*** | (2006.01) |
| ***B28D 1/18*** | (2006.01) |
| ***E21C 27/24*** | (2006.01) |
| ***E21C 25/10*** | (2006.01) |
| ***E21C 47/00*** | (2006.01) |

(52) U.S. Cl.

CPC ..... *E01C 23/088* (2013.01); *B28D 1/188* (2013.01); *E01C 23/127* (2013.01); *E21C 25/10* (2013.01); *E21C 27/24* (2013.01); *E21C 47/00* (2013.01)

(58) Field of Classification Search

CPC ... E01C 23/127; E01C 23/065; E01C 23/088; B28D 1/188

USPC ..... 299/39.2, 39.4, 39.8, 87.1

See application file for complete search history.

(56) References Cited

U.S. PATENT DOCUMENTS

| | | | | |
|---|---|---|---|---|
| 4,139,318 | A * | 2/1979 | Jakob et al. | 404/90 |
| 4,697,850 | A * | 10/1987 | Tuneblom | 299/87.1 |
| 7,380,887 | B2 * | 6/2008 | Latham | 299/87.1 |
| 2008/0164749 | A1 * | 7/2008 | Beach et al. | 299/106 |
| 2010/0074684 | A1 * | 3/2010 | Stockwell et al. | 404/91 |
| 2010/0244544 | A1 * | 9/2010 | Buhr et al. | 299/64 |
| 2012/0187745 | A1 | 7/2012 | Erdmann et al. | |
| 2013/0334866 | A1 * | 12/2013 | Pederson et al. | 299/39.4 |

FOREIGN PATENT DOCUMENTS

| | | | |
|---|---|---|---|
| DE | 202009004190 | U1 | 8/2010 |
| DE | 102010013983 | A1 | 10/2011 |

(Continued)

OTHER PUBLICATIONS

Espacent, English Translation of Claim 1 of DE 20 2009 004 190 U1, published Aug. 12, 2010 (2 pages).

(Continued)

*Primary Examiner* — David Bagnell
*Assistant Examiner* — Michael Goodwin
(74) *Attorney, Agent, or Firm* — Wood, Herron & Evans, LLP

(57) ABSTRACT

The present invention relates to a milling drum for a ground milling machine, wherein a material guiding device is provided, which diverts the milled material in the direction of stagger of milling devices disposed one behind the other, as regarded in the direction of rotation. For this purpose, in particular, a wear plate is provided, which can be selectively replaced on the material guiding device. A further aspect of the present invention relates to such a material guiding device and also to a wear plate for such a material guiding device.

18 Claims, 4 Drawing Sheets

(56) References Cited

FOREIGN PATENT DOCUMENTS

| | | | |
|---|---|---|---|
| DE | 102010014529 | A1 | 10/2011 |
| DE | 102010044649 | A1 | 3/2012 |
| DE | 102010051048 | A1 | 5/2012 |
| DE | 102011009092 | A1 | 7/2012 |
| EP | 2236745 | A2 | 10/2010 |
| EP | 2423384 | A2 | 2/2012 |

OTHER PUBLICATIONS

Espacenet, English Machine Translation of EP2236745A2, published on Oct. 6, 2010, retrieved from http://worldwide.espacenet.com on Feb. 13, 2013 (11 pages).

Espacenet, English Machine Translation of DE102010013983A1, published on Oct. 6, 2011, retrieved from http://worldwide.espacenet.com on Feb. 13, 2014 (10 pages).

Espacenet, English Machine Translation of EP2423384A2, published on Feb. 29, 2012, retrieved from http://worldwide.espacenet.com on Feb. 13, 2014 (24 pages).

Espacenet, English Machine Translation of DE102010044649A1, published on Mar. 8, 2012, retrieved from http://worldwide.espacenet.com on Feb. 13, 2014 (22 pages).

Espacenet, English Machine Translation of DE102010051048A1, published on May 16, 2012, retrieved from http://worldwide.espacenet.com on Feb. 13, 2014 (24 pages).

Espacenet, English Machine Translation of DE102010014529A1, published on Oct. 13, 2011, retrieved from http://worldwide.espacenet.com on Feb. 19, 2014 (13 pages).

German Patent Office, Search Report of German Application No. 10 2013 003 088.9, dated Nov. 7, 2013 (4 pages).

* cited by examiner

Fig. 4a
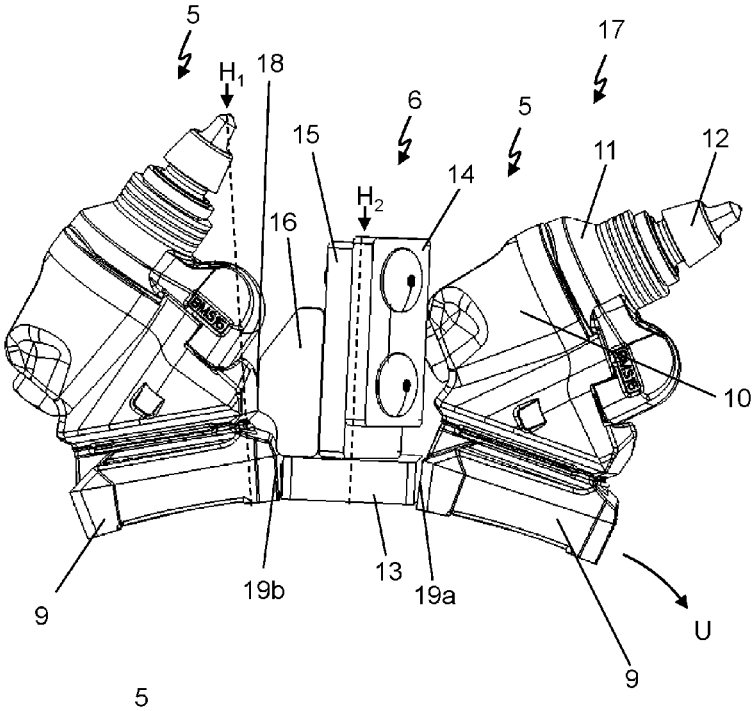
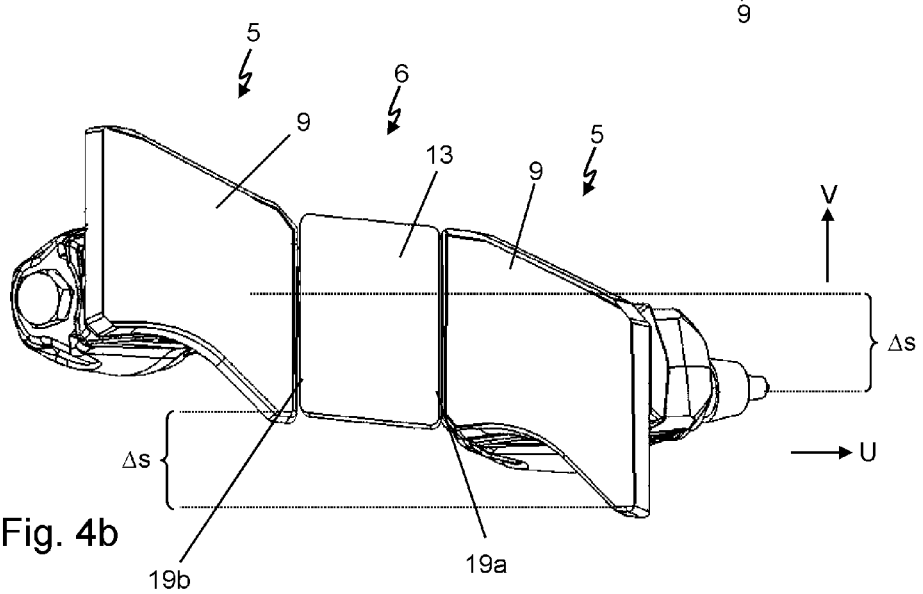
Fig. 4b

Fig. 5a
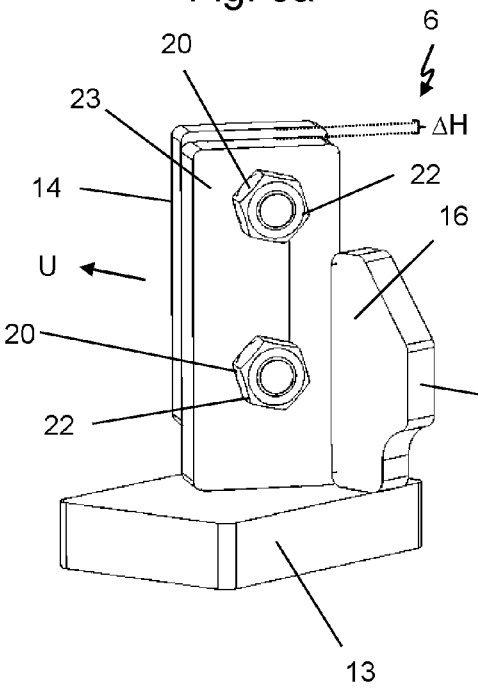
Fig. 5b
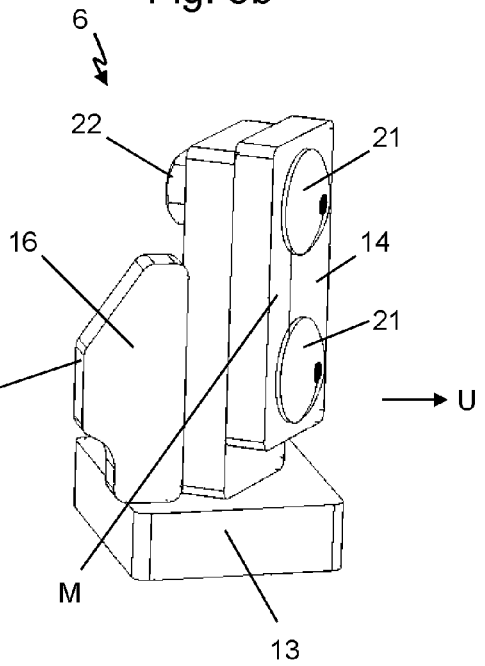
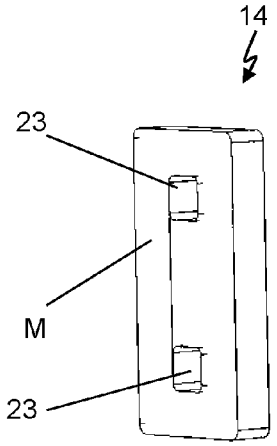
Fig. 5c

MILLING DRUM COMPRISING A, MORE PARTICULARLY REPLACEABLE, MATERIAL GUIDING DEVICE AND MATERIAL GUIDING DEVICE FOR A MILLING DRUM

CROSS-REFERENCE TO RELATED APPLICATIONS

The present application claims priority under 35 U.S.C. §119 of German Patent Application Nos. 10 2013 003 088.9, filed Feb. 22, 2013 and 10 2014 001 921.7, filed Feb. 12, 2014, the disclosures of which are hereby incorporated herein by reference in their entireties.

FIELD OF THE INVENTION

The present invention relates to a milling drum, to a material guiding device for a milling drum, and to a wear plate for such a material guiding device.

BACKGROUND OF THE INVENTION

Generic milling drums are used in construction machines for grinding soil, in particular, in ground milling machines, stabilizers, recyclers and/or surface miners. Such construction machines are known for a road milling machine, for example, from DE 10 2010 014 529 A1, for a stabilizer/recycler, for example, from EP 2 423 384 A2, and for a surface miner, for example, from EP 2 236 745 A2, which are incorporated herein by reference. In this respect the present invention also relates to such a construction machine comprising a milling drum according to the present invention. Typical fields of use are, therefore, in the construction of roads and paths as well as in the extraction of natural resources. Under working conditions, the milling drum is allowed to descend, while rotating, into the subsoil and in so doing, it mills up ground material for mixing purposes and/or for the purpose of removal. Typically, a generic milling drum of this kind comprises a hollow cylindrical supporting barrel that extends along an axis of rotation and has an external cylindrical surface. The axis of rotation extends in a horizontal plane and at right angles to the direction of travel of the ground milling drum. The external cylindrical surface of the supporting barrel comprises a plurality of milling devices. The milling devices are in general the working components with which the milling work of the rotating milling drum is done, that is to say, they are the working components that are responsible for the milling process. Such a milling device comprises, for example, a milling chisel, more particularly, a pick, and an appropriate holder including, for example, a base part and a quick-change tool holder attached to the supporting barrel. Such a milling device is described, for example, in the patent applications DE 10 2010 044 649 A1, DE 10 2010 051 048 A1 and DE 10 2010 013 983 A1 of the Applicant, which are incorporated herein by reference with respect to the design and function of such a milling device. Normally the milling tools are distributed and located on the basis of a specific arrangement on the external cylindrical surface of the supporting barrel. This arrangement includes, for example, in the case of road milling devices and surface miners, an at least partially spiraled layout to facilitate transportation of the milled material in the axial direction of the axis of rotation of the milling drum under operating conditions such as is indicated in, for example, DE 10 2011 009 092 A1. Such transportation of the milled material in the axial direction is desirable, for example, when the milled material is to be transported to an ejection port of a milling drum case. To this end, for example, side walls of the milling devices, more particularly, of the holding devices, can be utilized. Furthermore, it is known to equip a generic milling drum with at least one material guiding device formed separately and locally detached so as to form a material guiding device specifically designed for guiding the milled material under working conditions. This can refer, for example, to so-called ejectors that facilitate material transportation in the direction of rotation of the milling drum and which are required to transport, in particular, milled material, in a manner similar to shovels, from the milling chamber in the direction of rotation of the milling drum to the ejection port. Such an ejector is disclosed, for example, in DE 10 2011 009 092 A1 which is also incorporated herein by reference. The direction of rotation of the milling drum refers here to the direction of rotation of the milling drum about its axis of rotation under operation conditions.

Practical use of such milling drums has proven, however, that the milling devices themselves and with that the holders for the milling tools are subject to significant wear, particularly, when there are large linear distances between the individual milling tools and/or when there are large distances between the tools within the spiral configuration. This makes it necessary to replace the milling devices after comparatively short operational periods in order to ensure flawless operation of the milling drums. The linear distance refers here to the distance between the tips of the milling tools in two milling devices positioned one behind the other, as regarded in the direction of rotation of the milling drum, and as measured in the axial direction of the axis of rotation of the milling drum, that is to say, to the offset or degree of stagger of two milling devices positioned one behind the other in the direction of rotation as measured in the axial direction of the axis of rotation of the milling drum. Large linear distances between the milling devices will thus be found especially when the milling drum is equipped with only comparatively few milling devices and/or when the spiral configuration of the milling devices shows a comparatively steep gradient. The distance between tools, however, refers to the distance between the tips of, or between the same fixed points of, the milling tools of two milling devices positioned one behind the other within a spiral configuration, as measured in the axial direction of the axis of rotation of the milling drum, that is to say, to the offset of two milling devices positioned one behind the other in the direction of rotation within a common spiral configuration, as measured in the axial direction of the axis of rotation of the milling drum.

It is known in the prior art to counteract this wear process by applying additional hard facing to parts of the milling devices, such as, in particular, to quick-change holders and base holders and also to integrate comparatively elaborate additional screw-type flights. These measures are elaborate and comparatively expensive since, for example, the comparatively expensive hard facing must as a rule be renewed annually.

Thus, the object of the present invention is to provide a generic milling drum which makes it possible to operate the machine at comparatively less expense, especially with reduced wear on the milling devices, and which simultaneously provides reliable guidance of the milled material in the axial direction of the milling drum.

SUMMARY OF THE INVENTION

One aspect of the present invention is that at least one material guiding device is present that assumes, under working conditions, the function of guiding the milled material in the axial direction of the milling drum independently of the milling devices. In its simplest form, the material guiding device has at least one guide plate that enables, under working conditions, partial material transportation in the axial direction of the milling drum. The guide plate is that element of the material guiding device that assumes a substantially guiding function for the milled material under operating conditions of the milling drum. During rotational operation of the milling drum, the milled material rebounds from an external surface of the guide plate according to the present invention and is thus diverted by the plate at least partially in the axial direction of the axis of rotation of the milling drum. In its most simple form, the guide plate may be a flat plate-like element that is disposed with its top external surface at an angle to a plane perpendicular to the axis of rotation, as regarded in the material guiding direction. According to the present invention, the material guiding device is, as regarded in the peripheral direction of the milling drum, that is to say, in the direction of rotation of the milling drum about the axis of rotation, specifically, disposed between two milling devices disposed in staggered relationship such that, under operating conditions, it diverts milled material at least partially in the axial direction of the axis of rotation, that is to say, in the direction of stagger toward the rearward material guiding device, as regarded in the direction of rotation, away from the forward material guiding device, as regarded in the direction of rotation. In other words, the material guiding device guides the milled material in the axial direction of the milling drum from the forward milling device, as regarded in the direction of rotation with reference to the material guiding device, towards the rearward milling device, as regarded in the direction of rotation with reference to the material guiding device. The material guiding device thus compensates for the staggered free space between the two milling devices disposed one behind the other, as regarded in the direction of rotation, such that the flow of the milled material between these two milling devices, more particularly, in the axial direction of the axis of rotation of the milling drum, is guided substantially by the material guiding device and not by the milling tools themselves. Thus, the material load on the milling devices is reduced significantly and signs of wear on the milling devices are diminished. The guide plate of the material guiding device is optimally designed so as to have a size such that its axial width is at least almost equal to the tool distance in the axial direction of the axis of rotation of two milling tools disposed one behind the other, as regarded in the direction of rotation within the spiral configuration.

To ensure that the guiding effect of the material guiding devices is accomplished in the direction of the axis of rotation, as provided by the present invention, said material guiding devices are included, together with a plurality of milling devices, in at least one tool combine which is in turn located within a spiral. The material guiding device thus guides the milled material according to the present invention from a forward milling device within a spiral in the direction towards a rearward milling device, as regarded in the direction of rotation, within this spiral.

The term "spiral" or "spiral configuration" refers here to a spiraled or helical structure that winds around at least one section of the exterior surface of the supporting barrel of the milling drum. By 'section' is meant here at least one cylindrical partial segment along the axis of rotation of the milling drum. The spiral is thus a helical structure that winds at least sectionwise around the external surface of the supporting barrel in the direction of the axis of rotation about said axis. The material guiding devices and the milling devices are arranged in the spiral alternately, with an offset in the direction of the axis of rotation, in staggered relationship one behind the other, as regarded in the direction of rotation. A spiral shows an orientation that corresponds—mathematically speaking—to its pitch.

A tool combine, as referred to in the previous paragraphs, consists of at least two milling devices and also of at least one material guiding device and is arranged within a spiral. A "tool combine" is understood to mean a block arrangement such that the milling and material guiding devices pertaining to the tool combine form a working unit. Within a tool combine, there is always one material guiding device in each case arranged, in particular, in a way that, with regard of the orientation of the spiral, one milling device is disposed in front of, and one milling device behind, the material guiding device, such that the material guiding device is disposed so as to fit positively between the two milling devices, in particular, at least in part, the positive fit being produced, in particular, by the material guiding device and the parts of the milling devices that are closest to the external cylindrical surface of the supporting barrel, for example, by the base plate of a material guiding device and the pedestal of a milling device. A single milling device may pertain to a number of tool combines within a spiral if and when these are disposed directly one behind the other in the direction of orientation of the spiral.

In principal, it is possible to connect the guide plate of the material guiding device directly to the surface of the supporting barrel of the milling drum, for example, by the use of welded joints. Preferably, however, the material guiding device consists of a base plate and a guide plate, the latter being replaceably mounted, in particular, directly, on the base plate so as to project upwardly from the base plate. The base plate is that element of the material guiding device that is adjacent to the external cylindrical surface of the supporting barrel, which element can also, in particular, be attached directly to said external surface. Thus, the base plate serves, on the one hand, to attach the material guiding device, while it on the other hand serves to effect direct or indirect mounting of the guide plate, which is described in greater detail below.

In principal, the material guiding device can be designed as a single-piece component, wherein, in the case of a multi-component design, the individual components are rigidly interconnected. However it has proven to be advantageous when the guide plate is a wear plate that is replaceably mounted on the base plate. Since the guide plate is subjected to a significant degree of material stress by the milled material, strong signs of wear occur, especially on this element, so that it is advantageous when this element can be replaced on a regular basis and in as simple a manner as possible. To this end, it is possible, for example, to mount the guide plate in the form of a wear plate on the base plate by non-positive and/or positive fit or even by bonding. A wear plate is characterized, in particular, by the fact that it is mounted selectively and replaceably on the rest of the material guiding device. When a certain degree of wear has been reached, the respective connection between the material guiding device and the wear plate can be released and the latter can thus be replaced separately from the rest of the material guiding device, in which case complete disassembly of the material guiding device is not necessary. The wear plate can, in particular, be alternatively designed as an element that is symmetrical about one axis or as an element that is symmetrical, in particular, about three axes that are at right angles to each other. In this way, the wear plate, when only partially worn, can, for example, be turned about one of the symmetrical axes for the purpose of exposing less worn regions to further wear.

To make the replacement of the wear plate as efficient as possible, the material guiding device preferably consists of a holding device attached to the base plate, which is designed for, more particularly, releasable, holding of the wear plate. With this embodiment, the guide or wear plate is thus not directly attached to the base plate but rather indirectly via an appropriate holding device. Essential for the holding device is that it comprises means with which the wear plate can be attached thereto. Such means can, very particularly, be suitable clamped and/or bolted connections, etc., for example, so that the connection is a substantially positive and/or non-positive, more particularly, frictional connection.

One embodiment of the holding device comprises a supporting arm projecting above the base plate away from the supporting barrel to which the wear plate is attached. At one end, the supporting arm is thus preferably directly and rigidly connected to the base plate. At the other end, the supporting arm has a connection means that is designed to releasably accommodate the wear plate, in particular, via a bolted connection. With this embodiment, the holding device shows the three essential basic elements 'base plate', 'supporting arm' and 'wear plate', the base plate and the supporting arm forming a rigid interconnected unit to which the wear plate is releasably attached. The supporting arm projects upwardly, in particular, vertically, from the base plate and extends furthermore, with reference to the supporting barrel, preferably and substantially in the radial direction extending from the axis of rotation of the milling drum.

The advantages of the material guiding device according to the present invention are particularly eminent in combination with the aforementioned milling devices so that the present invention also includes, in particular, such a tool combine to be further described below. To this end, the present invention makes provision for the milling drum to comprise one or more tool combines consisting, in particular, of a number N of material guiding devices and a number N+1 of milling devices which altogether, in interaction with the individual elements, make it possible to efficiently transport milled material in the axial direction of the axis of rotation of the milling drum. Such a tool combine of the present invention is configured as a spiral and consists, as mentioned above, of at least two milling devices disposed one behind the other, as regarded in the direction of rotation of the milling drum, in spaced relationship, and also in staggered relationship in the axial direction thereof, and at least one material guiding device, which material guiding device is disposed between the two milling devices, as regarded in the direction of rotation of the milling drum, and has a material guiding surface, particularly, as part of the guide plate, that extends, at least partially, in the direction of stagger. Thus, the material guiding surface extends in the direction of rotation of the milling drum in a way such that the direction of stagger of the two milling devices is followed so as to form a kind of routing ramp for the milled material in the direction of stagger. The tool combine is thus characterized in that within a spiral arrangement at first a material guiding device follows a milling device, as regarded in the direction of rotation of the milling drum, which material guiding device is itself followed by a milling device. Regarded as a whole, this tool combine comprises material guiding devices and milling devices in an alternating arrangement, that is to say, they alternate in the direction of rotation within a spiral in which each tool combine starts with a milling device. The material guiding device serves as a compensatory element for the staggered arrangement of the milling devices one behind the other in the direction of rotation of the milling drum within a spiral and guides the milled material more easily across this offset in the axial direction of the milling drum. The material guiding surface suitable for this purpose is thus that surface of the guide plate along which the milled material glides under operating conditions. Due to the fact that the material guiding surface extends at least partially in the direction of stagger, it at least partially bridges the axial offset of the milling devices disposed one behind the other in the direction of rotation. In this way, when the milling drum rotates, the milled material no longer directly hits the following, axially staggered milling device but is preferentially directed by the material guiding device, at least partially, sideways past the following milling device.

During operation of the milling drum, the material guiding devices are exposed to significant loads due, in particular, to the milled material being pressed against the material guiding device. In order to achieve optimized force dissipation, the material guiding device is disposed, in particular, by way of its base plate, preferably so as to bear at least against the rearward milling device, as regarded in the direction of rotation of the milling drum. Under working conditions, the material guiding device is thus pressed partially, for example, by way of its base plate, contrary to the direction of rotation of the milling drum, against the milling device attached behind it so that a partial force dissipation via the fixing units of the milling device is possible. For this purpose, provision may also be made, for example, for the material guiding device to be firmly bonded to at least the milling device located behind it, as regarded in the direction of rotation. Furthermore, it is also possible to position the material guiding device on the milling drum in such a way that the material guiding device will, for example, by way of its base plate, bear against the milling device that is located on the supporting barrel of the milling drum ahead of it, as regarded in the direction of rotation, to which milling device it is, in particular, also firmly bonded. The material guiding device, in practice, is basically adjacent to the milling device, especially in those regions thereof that face the material guiding device with the exception of the working region of the tip of the milling tool. However, it has proven to be ideal when at least the base plate is adjacent to preferably the lower section of the milling device, for example, a pedestal and/or the base part of the rearward milling device. The pedestal is a supporting part commonly welded to the external cylindrical surface of the supporting barrel, which supporting part carries the other elements of the milling device, which include, for example, a holder for a milling tool and/or a quick change holder pertaining to the milling tool.

Ideally, the base plate of the material guiding device has the shape of a parallelogram. This allows for optimal integration thereof in a spiral-shaped overall structure composed of material guiding devices and milling devices. The base plate is ideally designed such that it is disposed with its long sides of the parallelogram parallel to the axis of rotation and with the short sides of the parallelogram substantially in the direction of rotation of the milling drum, wherein the latter are obliquely disposed in the direction of stagger of the rearward milling device towards the forward milling device and thus follow the direction of stagger counter to the direction of rotation of the milling drum.

Additionally or alternatively, the material guiding device preferably comprises a supporting device for the purpose of supporting the material guiding device against a milling device when under load under working conditions. The supporting device is, therefore, an additional element of the material guiding device, in particular, with regard to the base plate, by means of which the forces occurring under working conditions and originating from the movement of milled material across the material guiding device can be partially absorbed. The essential criterion of the supporting device is thus primarily its ability to enable the load to be dissipated to other elements on the milling drum. The supporting device is ideally a supporting bar that projects upwardly from the base plate and is attached behind the guide plate, as regarded in the direction of rotation of the milling drum. Thus, the supporting bar stabilizes the guide plate directly or indirectly from behind, as regarded in the direction of rotation, and thus absorbs part of the forces that are introduced by the milled material into the base plate and diverts these forces, for example, into the base plate and/or into an element that lies behind it, as regarded contrary to the direction of rotation.

The supporting bar is especially efficient when it has a supporting stop member that is adjacent to the milling device, in particular, to, say, a pedestal and/or to a base part and/or to a quick change holder of a milling device. The milling device against which the supporting bar is brought to bear is that milling device that is located behind the material guiding device, as regarded in the direction of rotation, against which the material guiding device is pressed, under working conditions, by the milled material. This arrangement has the advantage that when the supporting stop member is disposed, for example, with reference to the base plate of the material guiding device ideally above the base plate, there is an improved load diversion into the following milling device, as regarded contrary to the direction of rotation of the milling drum. The supporting stop member is designed preferably at least partially complementary to the region of contact to provide an area as wide as possible between the two elements. This region of contact further preferably extends at right angles to the direction of rotation of the milling drum.

Ideally, the supporting bar and at least one exterior surface of the guide plate are disposed at an angle to one another, ranging, in particular, between 190° and 250° and especially at an angle ranging between 230° and 240° in terms of the exterior sides of these elements, as regarded in the direction of stagger. This angle is defined in a plane perpendicular to the external surface of the supporting bar and a plane perpendicular to the external surface of the guide plate and designates the actual angle in said plane at which the external sides of the supporting bar and guide plate of the material guiding device are disposed. Thus, the supporting bar is ideally designed with one face parallel to the direction of rotation of the milling drum and the guide plate is disposed obliquely thereto.

It is obvious that the material guiding device does not extend beyond the milling devices, as regarded in the radial direction relative to the axis of rotation of the milling drum, in order not to impede access of the milling devices to the ground for milling operations. However, it has proven to be ideal when the maximum height of the milling device, as regarded in the radial direction away from the external cylindrical surface of the supporting barrel, is greater by a factor of 1.1 to 2 than the maximum height of the material guiding device in the radial direction. On the one hand, this ensures that the milling device can access the ground unimpeded by the material guiding device, and on the other hand, such a design of the material guiding device enables the milled material to be reliably guided in this region, thus efficiently reducing the wear on the next milling device.

The advantageous effects of the present invention emerge very clearly when the material guidance is carried out virtually without a break along the successively disposed milling devices and material guiding devices, as regarded in the direction of rotation of the milling drum. It is, therefore, advantageous for the tool combine according to the present invention when the milling devices and the material guiding devices form in their entirety a material guiding spiral that is as gapless as possible and that is formed so as to transport the milled material in the axial direction of the milling drum. The milling devices and the material guiding devices are thus preferably designed such that they form in their entirety a guide wall that is as gapless as possible, as regarded in the direction of stagger, this referring, in particular, to the base regions of the milling devices and of the material guiding devices. Thus, it is, in particular, the base region of each tool combine that is designed in its entirety as a continuous entity and is, in particular, in the form of a spiral material-guiding element mounted on the supporting barrel.

A further aspect of the present invention relates to a material guiding device for a milling drum according to the statements made above. Such material guiding devices can be combined with known milling devices and, when mounted on an appropriate supporting barrel, provide the aforementioned milling drums according to the present invention. Ideally, the material guiding device comprises at least one guide plate designed as a wear plate that sits on a respective holding device for the material guiding device, preferably interchangeably. With regard to the design of the material guiding device according to the present invention, reference is accordingly made to the aforementioned statements.

Finally, a further aspect of the present invention relates to a wear plate for a material guiding device, as described above, and the aforementioned statements are included herein by reference. The wear plate can be designed, in particular, as a substantially plane element for direct or indirect installation on the base plate of an aforementioned material guiding device. Furthermore, the wear plate can comprise parts of a holding device, more particularly, at least one through hole to accommodate a fastening bolt. Furthermore, the wear plate can be subjected to measures imparting increased hardness such as special hardening processes and/or the use of special alloys. Furthermore, provision may be made, according to the present invention, for the wear plate to have wear indicators that permit conclusions to be made concerning the degree of wear or indicate when replacement of the wear plate is required. For this purpose, for example, appropriate wear grooves or similar means may be present in the wear-intensive regions, such as the side walls of the wear plate. Furthermore, the wear plate can additionally or alternatively comprise positioners which allow for fast and exact positioning of the wear plate on the holding device of the material guiding device. Such positioners can be, for example, suitable edges or similar structures that have been given an appropriate complementary shape to fit the holding device.

BRIEF DESCRIPTION OF THE DRAWINGS

The present invention is described below in greater detail with reference to the exemplary embodiment illustrated in the figures, in which:

FIG. 4*a* is a diagrammatic side view of a detail of a region of the tool combine as shown in FIG. 3*a;*

FIG. 4*b* is a diagrammatic bottom view of the tool combine as shown in FIG. 4*a;*

FIG. 5*a* is an oblique perspective view of a material guiding device taken at an angle from the rear;

FIG. 5*b* is an oblique perspective side view of the material guiding device as shown in FIG. 5*b*; and FIG. 5*c* is an oblique perspective view of a wear plate.

Like components are designated in the figures with like reference numerals, but not every repeated component is separately named with a reference numeral in each figure.

DETAILED DESCRIPTION OF THE INVENTION

Figure 1:
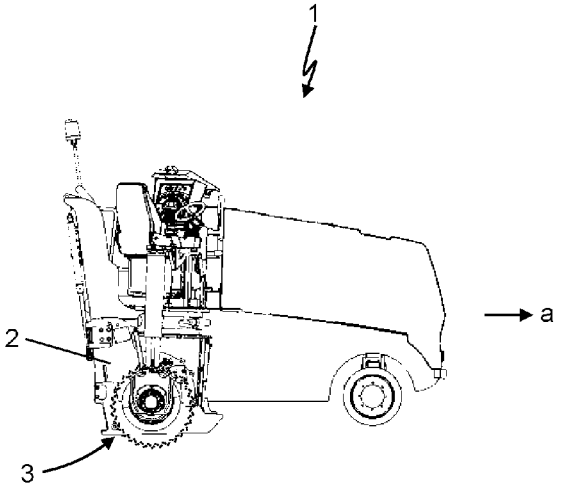
FIG. 1 is a diagrammatic side view of a road milling machine.

FIG. 1 refers first of all to a generic ground milling machine in which use is made of a milling drum 3 according to the present invention, which is shown highly diagrammatically and is described below in greater detail. It is, in fact, a road milling machine 1 that comprises in its rear end region a milling drum casing 2 in the interior of which a milling drum 3 is disposed, which is not visible in FIG. 1. Under working conditions, the drum rotates about an axis of rotation R that extends in a horizontal plane and at right angles to the direction of travel A. Under working conditions, the road milling machine 1 travels across the ground to be processed and into which the rotating milling drum is allowed to descend to a milling depth and mills the material of the ground, in order, for example, to remove the top layer of a road.

Figure 2:
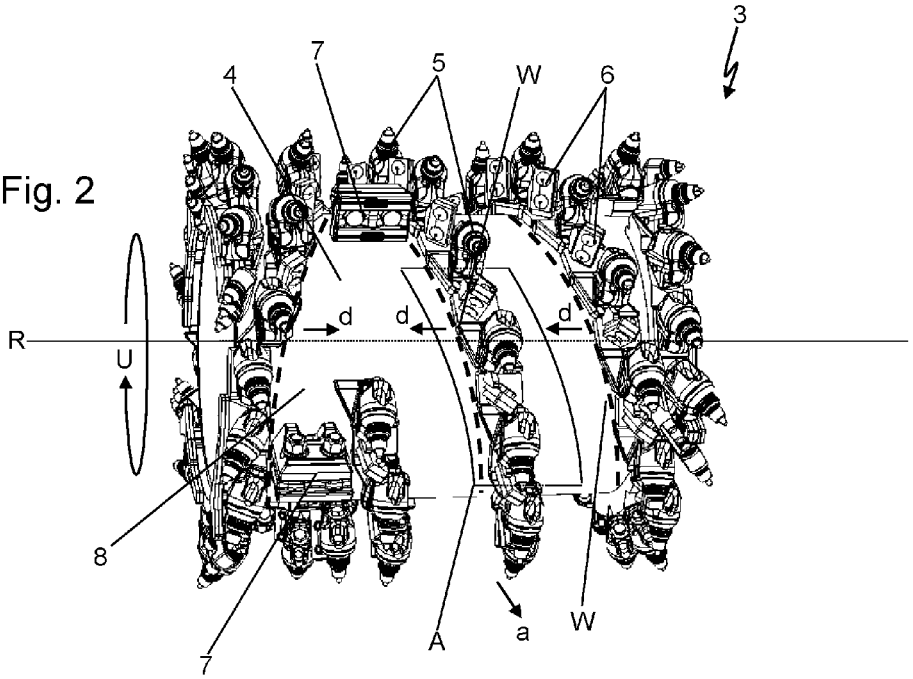
FIG. 2 is a diagrammatic perspective rear view of a milling drum.

Details of the design of the milling drum 3 are illustrated in FIG. 2. Essential elements of the milling drum 3 are a hollow-cylindrical supporting barrel 4, a plurality of milling devices 5, a plurality of material guiding devices 6, and also ejectors 7. Under working conditions, the milling drum 3 rotates about the axis of rotation R in the direction of rotation U. The milling devices 5 and the material guiding devices 6 are, except for marginal zones at the ends of the supporting barrel 4, disposed in the form of spirals W winding around the external cylindrical surface of the supporting barrel 4 which spirals W progress towards the ejectors 7. In FIG. 2, the spirals W are indicated by dashed lines in the base area of the milling devices 5 and the material guiding devices 6. The milling devices 5 and the material guiding devices 6 are disposed along these spirals W in the direction of rotation U in alternating relationship to one another so that the spirals W extend from the left and from the right towards one another on the external cylindrical surface 8 of the milling drum 3 to reach the region of the ejector 7. Under working conditions, the transportation of the milled material along the axis of rotation R in the direction of the arrow d towards the ejector 7 on the supporting barrel 4 is achieved by the spiraled arrangement of the milling devices 5 and the material guiding devices 6. Further details on the design of the milling devices 5 and the material guiding devices 6 are apparent from the other figures, to all of which reference is made below.

Figure 3A:
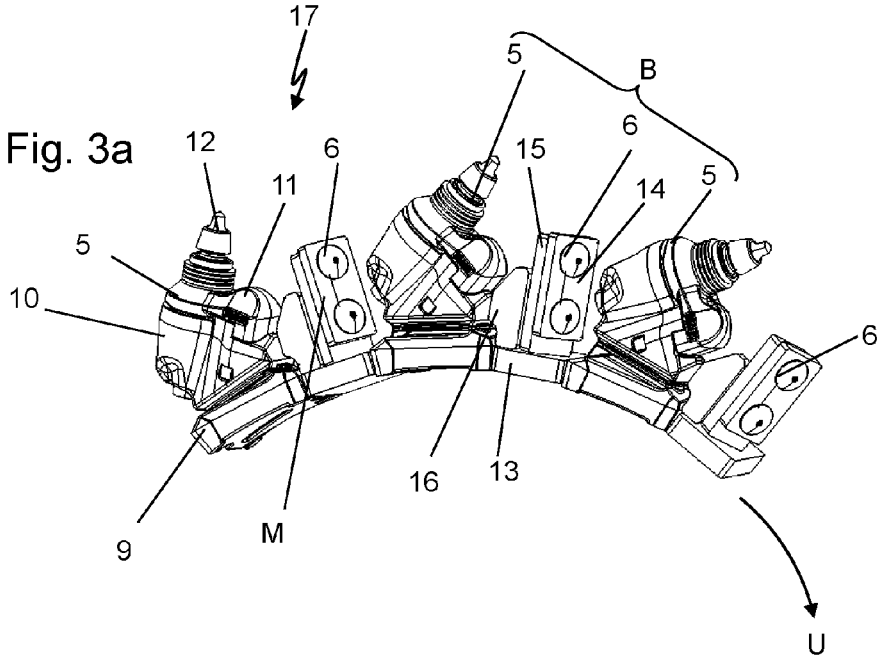
FIG. 3*a* is a diagrammatic side view of a tool combine as shown in FIG. 2.
Figure 3B:
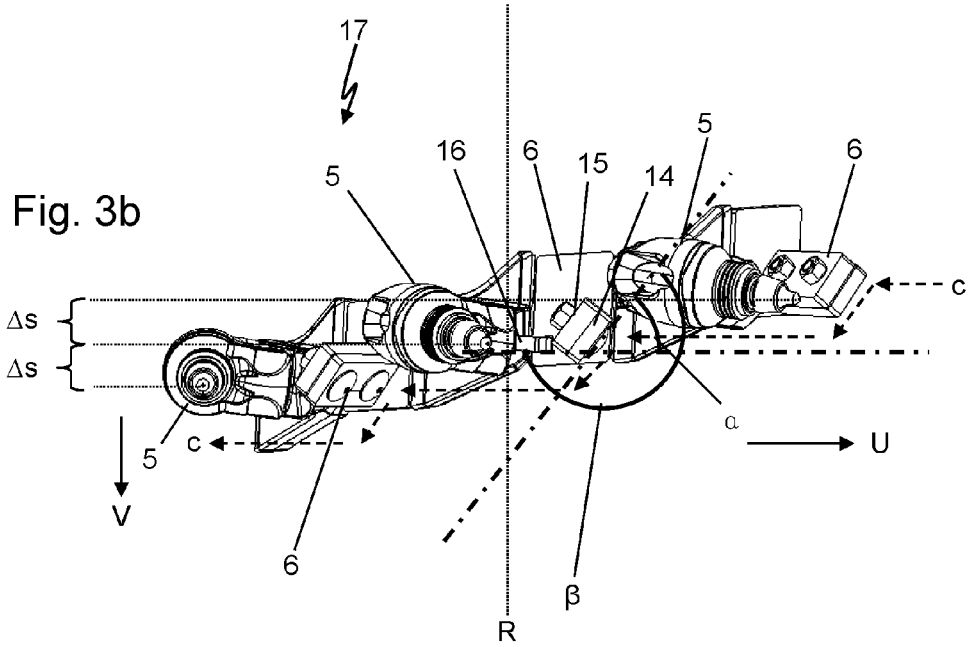
FIG. 3*b* is a diagrammatic top view of the tool combine as shown in FIG. 3*a;*

FIGS. 3*a* and 3*b* specifically illustrate group A of the milling devices 5 and the material guiding devices 6 as shown in FIG. 2 which as a whole form a tool combine 17. FIG. 3*a* illustrates first of all the alternating sequence of milling devices 5 and material guiding devices 6. Regarded in the direction of rotation U of the milling drum, a material guiding device 6 is always followed by a milling device 5.

Essential elements of the milling device 5 are, in the exemplary embodiment shown, a pedestal 9, a base part 10, a quick-change holder 11, and a pick 12. The pedestal 9 is firmly attached to the external cylindrical surface of the supporting barrel 4, for example, via welded joints. The base part 10 is positioned on the pedestal 9 and connected thereto and accommodates the quick-change holder 11 which in turn serves to accommodate the pick 12. From the top view shown in FIG. 3*d*, it is seen that the individual milling devices 5 are disposed along the axis of rotation R offset by the distance Δs defined by the spacing of the chisel tips of the picks 12 from one another. A line represents the movement of the chisel tip of the milling device as the milling drum rotates. Depending on the gradient of the spirals W, the tool spacing Δs varies with the respective embodiments of the milling drum 3.

A material guiding device 6 is disposed between each of the individual milling devices 5, as regarded in the direction of rotation of the milling drum 3, the essential elements of the material guiding device being a base plate 13, a guide plate designed as a wear plate 14, a holding plate 15 designed as a supporting arm, and a supporting bar 16. The base plate 13 is substantially of a flat shape and is disposed on the external cylindrical surface 8 of the supporting barrel 4 and, depending on the embodiment, welded thereto. With reference to the axis of rotation R, the holding plate 15 protrudes outwardly in the radial direction extending from the base plate to the exterior side of the milling drum 3 and projects upwardly therefrom. FIG. 3*b*, in particular, clearly shows that the holding plate 15 with the wear plate 14 positioned thereon at the front, as regarded contrary to the direction of rotation, is turned in the direction of stagger V of the milling devices 5 such that an oblique material guiding device surface is formed by the exterior surface of the wear plate 14 for the purpose of guiding the milled material in the direction of stagger V. FIG. 3*b* illustrates this effect with the dashed arrows c, which further illustrate the material flow of the milled material along the tool combine 17 as the milling drum 3 rotates and, in particular, highlights the guidance of material in the direction of stagger V (the milling devices 5 disposed one behind the other in the direction of rotation U being offset in the axial direction of the axis of rotation). When the milling drum 3 is active under working conditions, the milled material glides in the direction of stagger V over the exterior surface of the wear plate 14 along between two milling devices 5 and is, thus, diverted by the material guiding device 6 to the side of the respective milling device 5 that follows in the direction of stagger. This exterior surface thus operates as a material guiding surface M. With reference to a plane perpendicular to the axis of rotation R, the exterior surface of the wear plate 14 is thus at an angle of rotation a of about 50°. This diversion of the milled material, under operating conditions, thus prevents the milled material from being diverted exclusively in the axial direction by the milling devices 5, more particularly, by the base part 10, with the result that the degree of wear appearing at this location is reduced.

An essential feature for flawless functioning of the material guiding devices 6, in the case of this specific exemplary embodiment, is furthermore the supporting bar 16, which is disposed, as regarded in the direction of rotation U, to the rear of the holding plate 15, with which supporting bar 16 the holding plate 15 is partially in direct contact. If compressive forces are applied by the milled material to the wear plate 14 contrary to the direction of rotation U, they are partially passed on to the supporting bar 16 via the holding plate 15 disposed to the rear of the wear plate 14. The supporting bar is substantially aligned in the direction of rotation U, with reference to its width, and thus extends by way of its width parallel to the direction of rotation U. The supporting bar 16 directly attached to the base plate 13 comprises a supporting stop member 18 in its rear area, as regarded in the direction of rotation, which stop member is in direct contact with the foot region of the base part 10 of the following milling device 5, as regarded in the direction of rotation, as is further illustrated, in particular, in FIG. 4*a*. This provides indirect support for the wear plate 14 by the milling device 5 and, in the present exemplary embodiment, by the base part 10, which accomplishes a significant dissipation of the thrust caused by the milled material on the wear plate 15 of the material guiding device via the milling device 5.

FIGS. 4*a* and 4*b*, which illustrate that section of the tool combine that is marked B in FIG. 3*a*, further show that the base plate 13 is also in direct contact with the respective adjacent milling devices 5, more specifically with the base regions of the respective pedestal 9 in and contrary to the direction of rotation U. By this means also, the material guiding device 6 is supported via its base plate 13 by the milling device 5 that is located to the rear thereof, as regarded in the direction of rotation U. In order to compensate for the roundness of the supporting barrel 4, the region of contacts 19*a* and 19*b* of the base plate 13 are formed so as to extend in the radial direction so that the basic plane of the base plate 13 present on the external cylindrical surface 8 of the supporting barrel 4 is narrower in the direction of rotation U than the upper surface of the base plate 13 that faces outwardly in the radial direction. In this way, a positive connection of the base plate 13, as regarded in and contrary to the direction of rotation U, is achieved with respect to the forward and rearward milling devices 5, by which means the positional stability of the material guiding device 6 is likewise improved.

The base plate 13 is, furthermore, substantially in the form of a parallelogram, of which the longitudinal sides form the contact surfaces 19*a* and 19*b* and the short sides of this parallelogram are obliquely disposed in the direction of stagger V contrary to the direction of rotation.

Moreover, the external surface of the supporting bar 16 extending in the direction of stagger and the external surface of the wear plate 14 are at an angle β of approximately 235°. This angle is defined in a plane perpendicular to these two external surfaces.

Further details concerning the design of the material guiding device 6 are finally shown in FIGS. 5*a* to 5*c*, which illustrate in detail one of the material guiding devices 6 shown in the previous figures. According to this embodiment, the wear plate 14 is attached to the holding plate 15 via two bolted connections in spaced relationship in the radial direction, which bolted connections each comprise one round-head bolt 21 and one nut 22. For the purpose of establishing connection, there are provided in the wear plate 14 two through holes 23, into which the round-head screws 21 are inserted from the external surface of the wear plate 14. Complementary to the through holes 23 there are also provided through holes (not shown in the figures) in the holding plate 15 so that the round-head screws 21 can also pass through the wear plate 14 plus the holding plate 15, and these components can then be tightened together from the rear surface of the holding plate 15 by means of the nuts 22. The wear plate 14 is designed as a substantially flat, cuboid, plate-like element and protrudes, in particular, perpendicularly with an offset ΔH beyond the holding plate 15 in the radial direction, by which means the degree of wear on the holding plate 15 can be reduced.

In particular, FIG. 4*a* further illustrates that the height $H_1$ of the milling devices 5 (as regarded in the radial direction from the axis of rotation R towards the external cylindrical surface 8 of the supporting barrel 4) is greater than the height $H_2$ of the material guiding device 6 (in terms of the distance of the upper end of the wear plate 14 from the external cylindrical surface 8 of the supporting barrel 4, as regarded in the radial direction) so that the milling devices 5 protrude, at least with the tip region of the pick 12, beyond the material guiding devices 6 so that unimpeded access to the ground by the milling devices is ensured. Since the material guiding devices do not have any milling function but solely a material guiding function, particularly, in the axial direction of the milling drum 3, efficient milling by the milling drum 3 is thus made possible.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A milling drum, comprising:

a hollow cylindrical supporting barrel extending along an axis of rotation and having an external cylindrical surface;

a plurality of milling devices disposed on said external cylindrical surface, with each milling device comprising a milling chisel and a holder attached to said hollow cylindrical supporting barrel, the holder comprising a base part and a quick-change tool holder, with at least two milling devices of the plurality of milling devices being disposed within any one tool combine disposed in the form of a spiral (W) on said supporting barrel; and at least one material guiding device designed for guiding milled material under working conditions, the material guiding device comprising a base plate attached directly to said external cylindrical surface, and a guide plate replaceably mounted, directly or indirectly, on the base plate, wherein the material guiding device is disposed within said tool combine between said at least two milling devices pertaining to said spiral (W), as regarded in a direction of rotation (U), and further wherein said guide plate of said material guiding device is disposed such that under working conditions said material guiding device at least partially diverts the milled material in the axial direction of the axis of rotation (R).

2. The milling drum according to claim 1, wherein said guide plate is disposed on said base plate and projects upwardly from said base plate.

3. The milling drum according to claim 2, wherein said guide plate is a wear plate replaceably disposed on the base plate.

4. The milling drum according to claim 3, wherein said material guiding device comprises a holding device disposed on said base plate, which holding device is adapted to hold said wear plate.

5. The milling drum according to claim 4, wherein said holding device comprises a supporting arm upwardly projecting from said base plate, on which supporting arm said wear plate is mounted.

6. The milling drum according to claim 5, wherein said wear plate is mounted on said supporting arm via a bolted joint.

7. The milling drum according to claim 2, wherein said material guiding device is in contact with a rear milling device by way of its base plate, as regarded in the direction of rotation of said milling drum.

8. The milling drum according to claim 7, wherein said base plate is in contact with a pedestal pertaining to said rear milling device.

9. The milling drum according to claim 2, wherein said base plate has the shape of a parallelogram.

10. The milling drum according to claim 1, wherein said two milling devices disposed within said tool combine, as regarded in the direction of rotation (U) of the milling drum, are disposed in staggered relationship, as regarded in the axial direction of the milling drum, and a material guiding surface (M) associated with said material guiding device extends at least partially in the direction of stagger.

11. The milling drum according to claim 1, wherein said material guiding device comprises a supporting device for the purpose of supporting said material guiding device against a milling device when under load under working conditions.

12. The milling drum according to claim 11, wherein said supporting device is a supporting bar, which projects upwardly from said base plate and is disposed behind said guide plate, as regarded in the direction of rotation (U) of said milling drum.

13. The milling drum according to claim 12, wherein an external surface of said supporting bar and an external surface of said guide plate are in each case substantially planar and are disposed at an angle to one another ranging between 190° and 250°.

14. The milling drum according to claim 13, wherein an external surface of said supporting bar and an external surface of said guide plate are in each case substantially planar and are disposed at an angle to one another ranging between 230° and 240°.

15. The milling drum according to claim 12, wherein said supporting bar comprises a supporting stop member designed to rest against a milling device.

16. The milling drum according to claim 1, wherein a maximum height ($H_1$) of said milling devices, as regarded in the radial direction and as measured from said external cylindrical surface, is greater by the factor 1.1 to 2 than a maximum height ($H_2$) of said material guiding device, as regarded in the radial direction.

17. A material guiding device for a milling drum comprising a hollow cylindrical supporting barrel extending along an axis of rotation and having an external cylindrical service and a plurality of milling devices disposed on said external cylindrical surface, with each milling device comprising a milling chisel and a holder attached to said hollow cylindrical supporting barrel, the holder comprising a base part and a quick-change tool holder, with at least two milling devices of the plurality of milling devices being disposed within any one tool combine disposed in the form of a spiral (W) on said supporting barrel, said material guiding device comprising:

at least one material guiding device designed for guiding milled material under working conditions, the material guiding device comprising a base plate attached directly to said external cylindrical surface, and a guide plate replaceably mounted, directly or indirectly, on the base plate, wherein the material guiding device is disposed within said tool combine between said at least two milling devices pertaining to said spiral (W), as regarded in a direction of rotation (U), and further wherein said guide plate of said material guiding device is disposed between two staggered milling devices, as regarded in the direction of rotation of the milling drum, such that under working conditions said material guiding device at least partially diverts the milled material in the axial direction of the axis of rotation (R).

18. The material guiding device according to claim 17, wherein said guide plate comprises a wear plate.

* * * * *